US008683962B2

(12) United States Patent
Jacques

(10) Patent No.: US 8,683,962 B2
(45) Date of Patent: Apr. 1, 2014

(54) COOLING SYSTEM FOR AN INTERNAL COMBUSTION ENGINE

(75) Inventor: Robert Lionel Jacques, Troy, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 161 days.

(21) Appl. No.: 13/089,643

(22) Filed: Apr. 19, 2011

(65) Prior Publication Data

US 2012/0266829 A1 Oct. 25, 2012

(51) Int. Cl.
*F01P 7/02* (2006.01)
*F01P 1/06* (2006.01)

(52) U.S. Cl.
USPC ..... 123/41.04; 123/41.34

(58) Field of Classification Search
USPC ..... 123/41.01, 41.34, 41.04
See application file for complete search history.

(56) References Cited

U.S. PATENT DOCUMENTS 4,612,767 A * 9/1986 Engquist et al. ..... 60/321
4,700,664 A * 10/1987 Hayashi et al. ..... 123/41.27
6,742,480 B2 * 6/2004 Onimaru et al. ..... 123/41.01
7,146,807 B1 * 12/2006 Mondelci ..... 60/321
2002/0195090 A1 * 12/2002 Marsh et al. ..... 123/563
2006/0080958 A1 * 4/2006 Anthon ..... 60/599
2006/0130470 A1 * 6/2006 Dorn et al. ..... 60/309
2008/0115498 A1 * 5/2008 Patel et al. ..... 60/752
2009/0000118 A1 * 1/2009 Squires ..... 29/888.01
2009/0277172 A1 * 11/2009 Nordling ..... 60/614
2010/0101226 A1 * 4/2010 Shutty et al. ..... 60/602

FOREIGN PATENT DOCUMENTS

CN 101400462 4/2009

OTHER PUBLICATIONS

Office Action regarding related CN Application No. 200780008973; dated Jan. 6, 2014; 6 pgs.; all references previously cited or cited herein.

* cited by examiner

*Primary Examiner* — Lindsay Low
*Assistant Examiner* — Charles Brauch
(74) *Attorney, Agent, or Firm* — Cantor Colburn LLP

(57) ABSTRACT

A cooling system for an internal combustion engine comprises a tubular conduit configured to conduct coolant to and from various components of the internal combustion engine and to remove excess heat therefrom. A shield portion is fluidly coupled inline of the tubular conduit and is disposed between a heat source and a cooler operating component. The expanded portion further comprises a cooling body, an inlet in fluid communication with the tubular conduit and configured to conduct coolant into the cooling body and an outlet in fluid communication with the tubular conduit and is configured to conduct coolant out of the cooling body.

14 Claims, 2 Drawing Sheets

COOLING SYSTEM FOR AN INTERNAL COMBUSTION ENGINE

FIELD OF THE INVENTION

Exemplary embodiments of the present invention relate to cooling systems for internal combustion engines and, more particularly, a coolant line or conduit for a cooling system that is configured as a heat shield/heat sink for components of an internal combustion engine.

BACKGROUND

Customer demand for smaller and more fuel efficient motor vehicles has led designers to consider smaller powertrains that utilize energy efficient devices. Examples include turbochargers that have not traditionally been considered as "common" in many vehicle applications. In addition, smaller vehicles present packaging challenges for all types of powertrains that may require unique solutions to issues such as cooling; especially when hot components must be placed in close proximity to those that may not be well suited to elevated temperatures.

Heat shields are typically utilized between hot and cooler operating components to protect the cooler running components from heat damage. However, heat shields are a space consuming "extra component" for which there may not be installation space, and which may add cost and complexity to the overall system.

SUMMARY

In an exemplary embodiment, a cooling system for an internal combustion engine comprises a tubular conduit configured to conduct coolant to and from various components of the internal combustion engine and to remove excess heat therefrom. An expanded shield portion is fluidly coupled inline of the tubular conduit and is disposed between a heat source and a cooler operating component. The expanded shield portion further comprises a hollow cooling body, an inlet in fluid communication with the tubular conduit and configured to conduct coolant into the hollow cooling body and an outlet in fluid communication with the tubular conduit and configured to conduct coolant out of the hollow cooling body.

In another exemplary embodiment, an internal combustion engine comprises a cylinder head, an exhaust driven turbocharger disposed adjacent to the cylinder head, and a cooling system comprising a tubular conduit disposed between the exhaust driven turbocharger and the cylinder head. The cooling system further comprises an expanded shield portion fluidly coupled inline of the tubular conduit and between the exhaust driven turbocharger and the cylinder head. The expanded shield portion has a hollow cooling body, an inlet in fluid communication with the tubular conduit and configured to conduct coolant into the hollow cooling body and an outlet in fluid communication with the tubular conduit and configured to conduct coolant out of the hollow cooling body.

The above features and advantages, and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of the embodiments, the detailed description referring to the drawings in which.

DESCRIPTION OF THE EMBODIMENTS

Figure 1:
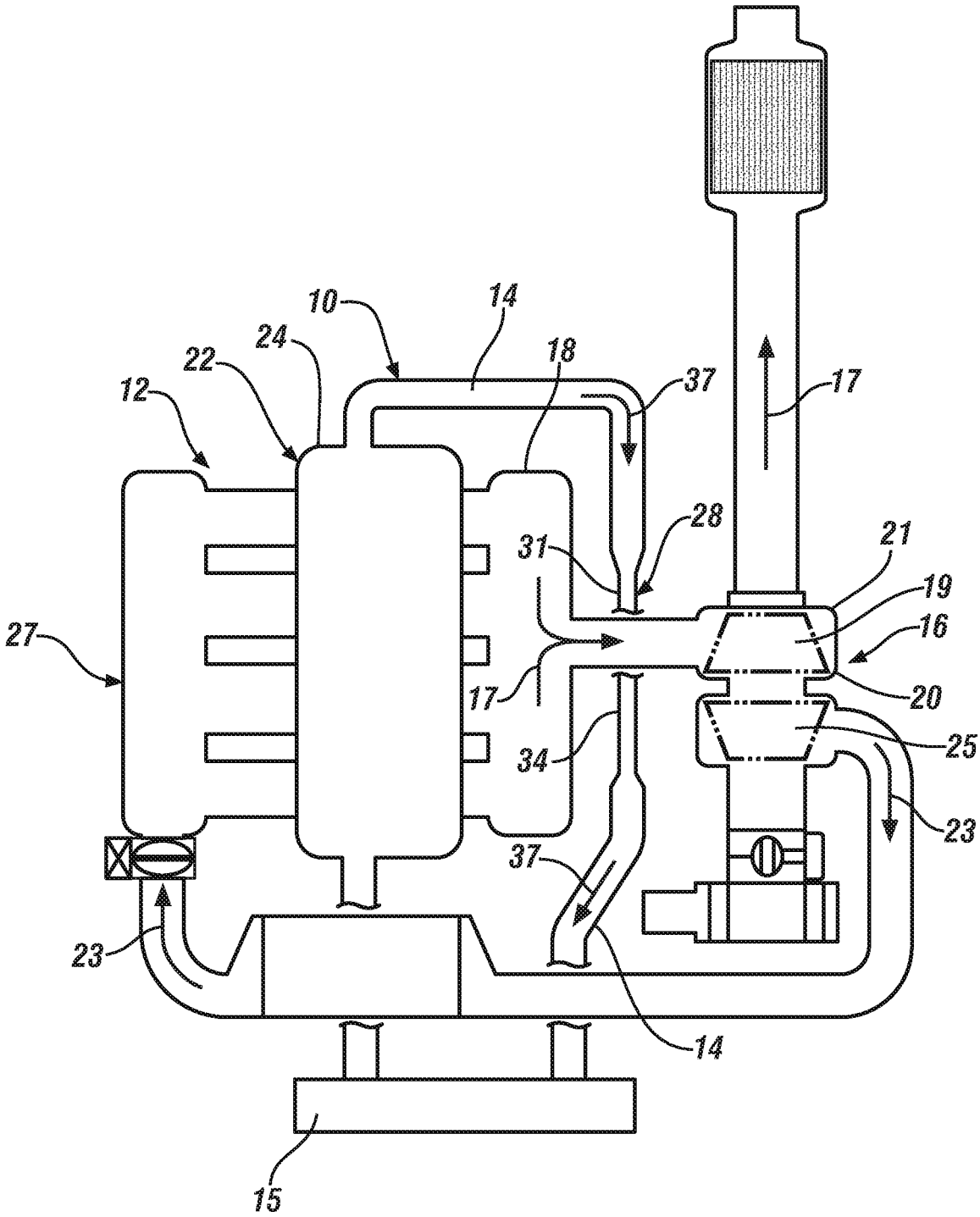
FIG. 1 is a schematic view of an internal combustion engine embodying features of the invention.

The following description is merely exemplary in nature and is not intended to limit the present disclosure, its application or uses. It should be understood that throughout the drawings, corresponding reference numerals indicate like or corresponding parts and features.

Figure 2:
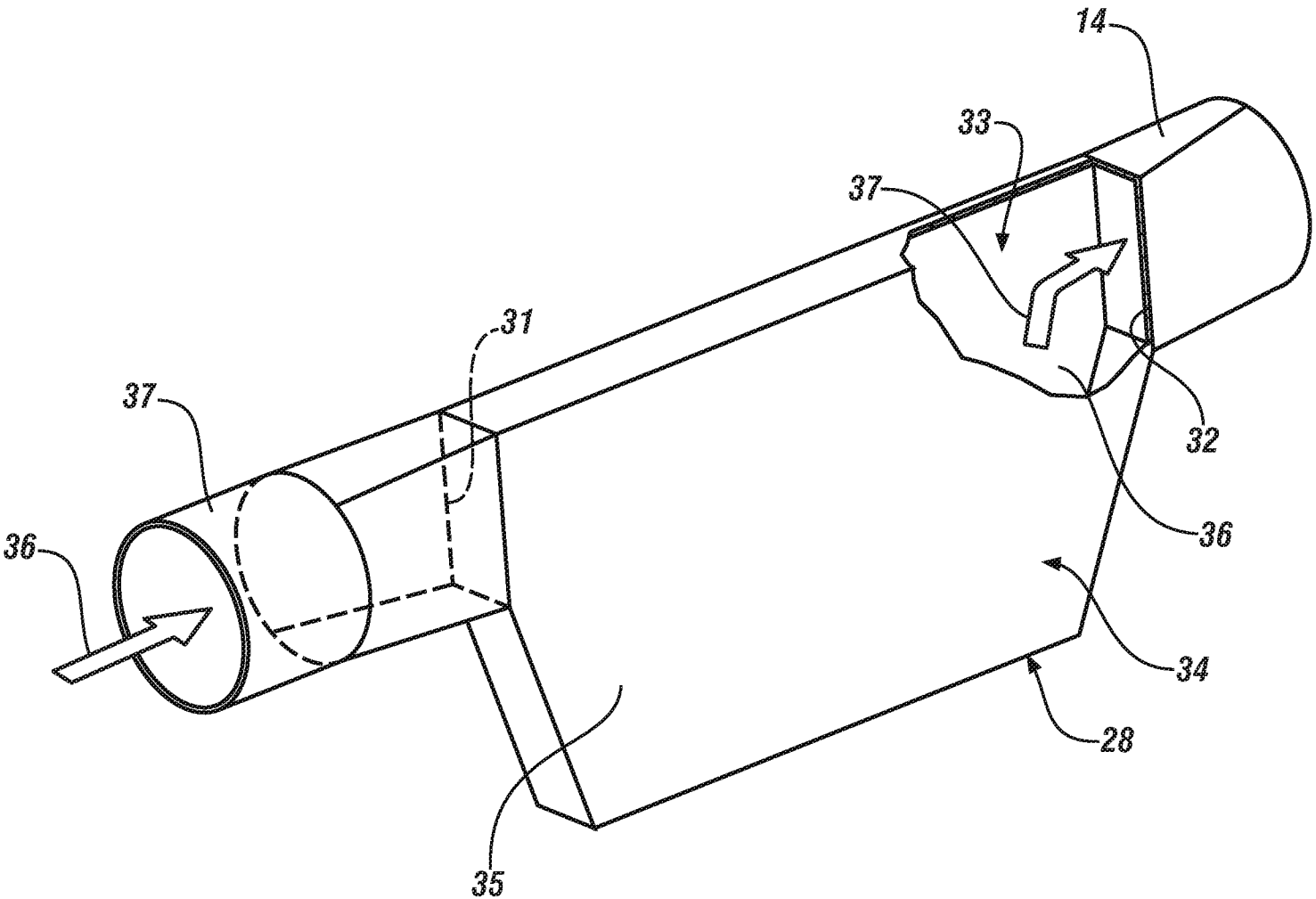
FIG. 2 is an enlarged view of a portion of a cooling system embodying features of the invention.

Referring to FIGS. 1 and 2, an exemplary embodiment of the invention is directed to a cooling system 10 for an internal combustion engine 12. In an exemplary embodiment, the cooling system 10 comprises a tubular cooling line or conduit 14 that conducts coolant from a cooling reservoir 15, such as a radiator, to various high temperature components of the internal combustion engine 12 that require the removal of excess heat therefrom. In the embodiment shown in FIG. 1, an example of such a high temperature component is an exhaust driven turbocharger 16 that is configured to receive exhaust gas 17 from an exhaust manifold or conduit 18 of the internal combustion engine 12. The exhaust gas drives a turbine wheel 19 that is rotatably supported within the exhaust side 21 of the turbocharger housing 20 which in turn rotates a compressor wheel 25 through a rotatable shaft (not shown) to supply compressed combustion air 23 to the intake system of the internal combustion engine 12. The general operation of the exhaust driven turbocharger 16 is well known in the art and will not be further discussed herein.

The intake system 27 is typically housed, at least in part, within a cylinder head assembly 22 of the internal combustion engine 12. The cylinder head assembly 22 is closed by a valve cover 24 that encloses and protects the engine valve train (not shown) from exposure to the elements; as they may exist in the engine compartment of a motor vehicle or other location depending upon the application of the internal combustion engine 12. When compared to the operating temperatures of the turbocharger 16, the cylinder head assembly 22 may be a considered a cool temperature component, or cooler operating component, for purposes of the following description of the invention. In turn, the turbocharger 16 may be considered a heat source, or hotter operating component, of the internal combustion engine 12.

As illustrated in the exemplary embodiment of FIGS. 1 and 2, the tubular conduit 14 is routed to extend between the exhaust driven turbocharger 16 and the cylinder head assembly 22 of the internal combustion engine 12. Due to the close mounting proximity of the exhaust driven turbocharger 16 to the cylinder head assembly 22 of the internal combustion engine 12, high temperatures radiating from the turbocharger housing 20 may cause a significant temperature differential ("ΔT") across the cylinder head assembly 22 resulting in deformation of portions of the cylinder head assembly 22 and related components.

In the exemplary embodiment illustrated in FIG. 2, the tubular conduit 14 includes a shield portion 28 that is configured to extend between the heat source, in this example the hot turbocharger housing 20, and the cooler operating component, in this example the cylinder head assembly 22. The shield portion 28 comprises an inlet 31, an outlet 32 and a cooling body 34 defining a coolant flow passage 36 between the inlet and the outlet 31, 32 respectively. As such, the shield portion 28 is fluidly coupled inline of the tubular conduit 14. In a preferred embodiment, the inlet and the outlet 31, 32 respectively, of the shield portion 28 fluidly communicate with an upper portion 33 of the coolant flow passage 36 of the cooling body 34 in order to prevent the development of air or steam pockets in cooling body 34. This could prevent the efficient flow of coolant 37 therethrough and could prevent efficient heat transfer if steam or air was allowed to accumulate in the lower portion 35. Such an air or steam pocket could affect the efficient flow of coolant 37 through the coolant flow passage 36 of the cooling body 34 and the tubular conduit 14. The coolant flow passage 36 of the cooling body 34 is preferably configured with a hydraulic diameter that is substantially equivalent to the hydraulic diameter of the tubular conduit 14 to assure an adequate flow of coolant 37 through the cooling system 10. Additionally, while the cooling body 34 is illustrated as having a high surface area, hollow rectangular cross section or shape, it is contemplated that the shape may be varied to suit a particular shielding application and may contain baffles (not shown) or other devices for turbulating the coolant passing therethrough to increase the rate of heat transfer therefrom.

The shield portion 28 is, in an exemplary embodiment, configured to extend between hot and cooler components to thereby function as a heat exchanger as well as a heat shield without the requirement of two separate components in an application having limited space. In addition, and unlike typical heat shields used for such purposes, the shield portion 28 has the advantage of a continuous flow of coolant 37 therethrough which will remove excess heat from the shielded area rather than simply deflecting the heat or barring its movement from the hot to the cooler component. By varying the coolant flow rate through the tubular conduit 14, and thus the shield portion 28, the rate and quantity of heat removed may also be varied. Such removal of heat is advantageous in that it lowers the overall heat concentration in the region in which the expanded shield portion 28 is disposed.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed for carrying out this invention, but that the invention will include all embodiments falling within the scope of the present application.

What is claimed is:

1. A cooling system for an internal combustion engine comprising:

a tubular conduit configured to conduct coolant to and from various components of the internal combustion engine to remove excess heat therefrom;

a shield portion fluidly coupled inline of the tubular conduit and disposed between a heat source and a cooler operating component, the shield portion further comprising:

a cooling body;

a rectangular inlet in fluid communication with the tubular conduit and configured to conduct coolant into the cooling body; and an outlet in fluid communication with the tubular conduit and configured to conduct coolant out of the cooling body.

2. The cooling system of claim 1, wherein the cooling body comprises a high surface area, hollow rectangular cross section.

3. The cooling system of claim 1, wherein the inlet and the outlet are disposed at an upper portion of the cooling body.

4. The cooling system of claim 2, wherein the hollow cooling body is configured with a hydraulic diameter that is substantially equivalent to the hydraulic diameter of the tubular conduit.

5. The cooling system of claim 1, wherein the rate of coolant flowing through the tubular conduit and the shield portion is variable.

6. An internal combustion engine comprising:

a cylinder head;

an exhaust driven turbocharger disposed adjacent to the cylinder head; and a cooling system comprising a tubular conduit disposed between the exhaust driven turbocharger and the cylinder head and further comprising:

a shield portion fluidly coupled inline of the tubular conduit and disposed between the exhaust driven turbocharger and the cylinder head to facilitate reducing heat transfer therebetween, the shield portion having a cooling body with an inlet in fluid communication with the tubular conduit and configured to conduct coolant into the cooling body and an outlet in fluid communication with the tubular conduit and configured to conduct coolant out of the cooling body.

7. The internal combustion engine of claim 6, wherein the cooling body comprises a high surface area, hollow rectangular cross section.

8. The internal combustion engine of claim 6, wherein the inlet and the outlet are disposed at an upper portion of the cooling body.

9. The internal combustion engine of claim 6, wherein the cooling body is configured with a hydraulic diameter that is substantially equivalent to the hydraulic diameter of the tubular conduit.

10. The internal combustion engine of claim 6, wherein the rate of coolant flowing through the tubular conduit and the shield portion is variable.

11. The cooling system of claim 1, wherein the outlet is rectangular.

12. The cooling system of claim 1, wherein the cooling body comprises a top wall, a bottom wall, an inlet side wall, and an outlet side wall, wherein the inlet and outlet side walls are tapered.

13. The cooling system of claim 12, wherein the cooling body defines an open cavity extending between the top and bottom walls and the inlet and outlet side walls.

14. The cooling system of claim 2, wherein a width of the hollow rectangular cross section is substantially constant from the inlet to the outlet.

* * * * *